US009555309B1

(12) United States Patent
LaBar et al.

(10) Patent No.: US 9,555,309 B1
(45) Date of Patent: Jan. 31, 2017

(54) ADJUSTABLE JERK BLOCK

(71) Applicants: Robert D. LaBar, Lake Worth, FL (US); Mark C. Albright, Hypoluxo, FL (US)

(72) Inventors: Robert D. LaBar, Lake Worth, FL (US); Mark C. Albright, Hypoluxo, FL (US)

( * ) Notice: Subject to any disclaimer, the term of this patent is extended or adjusted under 35 U.S.C. 154(b) by 0 days.

(21) Appl. No.: 14/862,424

(22) Filed: Sep. 23, 2015

(51) Int. Cl.
*A63B 21/078* (2006.01)
*A63B 71/06* (2006.01)
*A63B 21/072* (2006.01)

(52) U.S. Cl.
CPC ..... *A63B 71/06* (2013.01); *A63B 21/0724* (2013.01); *A63B 2071/0694* (2013.01)

(58) Field of Classification Search
USPC ..... 482/1–148
See application file for complete search history.

(56) References Cited

U.S. PATENT DOCUMENTS 2,217,704 A * 10/1940 Quayle ..... B62B 3/0625 254/10 C
2,952,370 A * 9/1960 Long ..... A01D 45/16 414/26
3,193,301 A * 7/1965 Talbert ..... B60P 7/13 254/4 R
3,280,939 A * 10/1966 Smith ..... E04G 1/34 182/132
3,519,243 A * 7/1970 Kleiber ..... B28B 7/245 249/119
4,949,959 A 8/1990 Stevens
4,998,721 A 3/1991 Anders et al.
5,048,826 A 9/1991 Ryan
5,310,394 A 5/1994 Kallios
7,637,852 B2 12/2009 Hoole
7,674,208 B2 3/2010 Hoole
8,056,677 B1 * 11/2011 Roberts ..... A01D 46/20 182/148
8,245,719 B2 * 8/2012 Kirby ..... A61H 3/04 135/66
8,910,326 B2 * 12/2014 Wilson ..... A61G 7/10 5/81.1 R
8,926,181 B2 1/2015 Hsu
2006/0011228 A1 * 1/2006 Craig ..... A61H 3/04 135/67
2011/0183818 A1 7/2011 Mitchell et al.
2015/0167410 A1 * 6/2015 Garber ..... E21B 19/166 29/407.02

* cited by examiner

*Primary Examiner* — Stephen Crow
(74) *Attorney, Agent, or Firm* — McHale & Slavin P.A.

(57) ABSTRACT

Disclosed is a portable lifting jerk block for use in holding barbells used in weightlifting. The jerk block allows an individual to position a barbell at most any height by use of hydraulic lift member providing safety and convenience to the operator. A laser leveling light coordinates two adjoining jerk blocks providing a visual signal by highlight indicia on the adjoining lifting jerk block, or producing an audible tone when a laser light on an adjoining jerk block illuminates a photo cell detector to assure a level support for the barbell when positioned between the lifting jerk blocks.

11 Claims, 4 Drawing Sheets

ADJUSTABLE JERK BLOCK

FIELD OF THE INVENTION

This invention relates to weight training, and more particularly, to a jerk block for barbells that is adjustable in height and can be leveled by a laser light to assure proper lifting.

BACKGROUND OF THE INVENTION

In the field of weight lifting, barbells are used in weight training and bodybuilding. Barbells consist of an elongated bar that is loaded at either end with weights. The amount of weight is changed by the addition or removal of weight plates installed on each end of the bar. The length of the bar depends upon the manufacturer and in certain instances the proposed event. For instance, a men's Olympic barbell is 7.2 feet long and weighs approximately 44 lbs. A women's Olympic barbell is approximately 6.6 feet long and weighs 33 lbs. While there is no fixed length for the barbell, stands are typically placed inside the weights and catch the bar. This limits the catch area for the barbell making it more difficult to set down once the individual has performed an event.

The type of bar may also vary depending upon the use, and whether the bar is used in competition. Typically barbells are used in the form of free weights and the motion is not determined by, or limited by, a machine that carries the weights. The weight lifter of a free weight is able to lift the weight without being constrained by a predetermined path. The weight lifter must not only lift the free barbell with weights but stabilize the motion throughout the lift. The result is a lifting exercise that not only builds muscle but causes the weight lifter to develop dimensional stability during the lift.

Power lifting requires use of a stiffer bar for heavy weights such as those used in the squat. These bars may be longer to allow loading of additional weights and thicker to deform less under the load. Essentially, barbells can be used for many different exercises, which causes different weights to be used, different sized bars to be employed, both in length and diameter, as well as flexibility. Known barbell exercises include the bench press, the incline barbell press, the close grip bench press, the standing curl, the reverse curl, the wrist curl, the overhead press, the shrug, the bentover row, the upright row, clean and jerk, the deadlift, the stiff legged deadlift, squats, hack squats, and the snatch. This invention is directed to the weightlifting techniques known as the "clean & jerk" and the "snatch".

The result is the weight lifter is required to either have multiple stands to address the various configurations, or limit the type of lift that can be done with the barbell. A problem with free weights is their potential to cause injury. The weights are directly loaded onto the end of the elongated bar making it difficult for a weight lifter to get into a proper position for lifting of the barbell for use, and releasing the barbell after use. This problem can be reduced by the use of spotters, which is not always possible. The placement of a barbell on a conventional stand can be used to position the weights at a designated height, but lack ease of adjustability. For instance, due to the weight involved the weight lifter must take breaks between lifts and/or alternate with others for use of the barbell. Each weight lifter may be of a different height and movement of a weight barbell to a particular height can be difficult and time consuming. When a weight lifter is performing a frontal squat, the ability to lift the barbell safely is dependent upon the barbell being at an ideal height and assuring that the barbell is horizontally level. Typically a barbell is used in conjunction with a stand wherein barbell holders are adjusted in height through counting of securement pins or marking indicia.

Self-spotting machines have addressed eliminating the need for one or more spotters. For example, U.S. Pat. No. 4,949,959 discloses a barbell assist device utilizing a motor-driven yoke assembly. The yoke assembly provides cables that extend around sheaves and downwardly from each end of the housing to support a barbell over a weight bench.

U.S. Pat. No. 5,048,826 discloses a device utilizing a winch assembly to retract and release cables supporting the barbell.

U.S. Pat. No. 5,310,394 discloses a spotter system for weightlifters employing a pneumatic piston and cylinder. The cylinder provides lift assistance to the barbell through a lever arm, chain drive, pulley and cables.

U.S. Pat. No. 4,998,721 discloses a weightlifter's exercise apparatus utilizing two motor-assisted assemblies supporting a barbell through cables attached to each end. Although the two motors allow independent assist from each side, no positive method is disclosed to ensuring user-control of the weights before disengaging the supports.

U.S. Pat. No. 7,637,852 and U.S. Pat. No. 7,674,208 disclose a device that was intended to elevate a barbell with weights and hold the barbell in a stable elevated position so weights can be removed and replaced. The barbell seat is tapered in a laterally outward direction so that the weights that are closest to the middle of the bar rest on the higher part of the seat. The barbell weights that are further from the middle of the bar are elevated and can be removed.

U.S. Patent Publication No. 2011/0183818 discloses a device intended to elevate a barbell so that the weights can be removed. The device teaches a barbell support comprising an elongated leverage handle that is affixed to at least one pivot foot. The barbell is placed in the cradle with the pivot foot against the ground. The leverage handle is manipulated to raise the cradle relative to the pivot foot and elevate the cradle and barbell above the ground.

U.S. Pat. No. 8,926,181 discloses a safety device for lifting a barbell loaded with barbell weights for safe removal of the barbell weights. The device can elevate a barbell containing very heavy weights off of the floor. The device can lift weights by rotating the device to gradually rotate a cam lobe underneath the barbell thereby lifting the barbell. The device serves as a barbell stand and will support the barbell in a stable position during removal of the weights.

What is lacking in the industry is a barbell jerk block that can be easily moved, can be lowered into a small stance, can be lifted to accommodate most any height, an include a means to track the level of the jerk blocks to assure the individual has a balanced foundation for the weight lifting exercises.

SUMMARY OF THE INVENTION

Disclosed is an adjustable and portable jerk block for use with barbells primary for the primary lifts known as "clean & jerk" and the "snatch". During a clean & jerk, the barbell would be lifted from the floor to the shoulders for the clean, and then in a separate motion the barbell would be pressed or "jerked" overhead for the jerk.

The jerk block of the instant invention is mounted with wheels and can be placed in position vertically for storage, or horizontally for ease of positioning. Upon positioning, the body of the jerk block can be lifted to a height that will accommodate the particular lifting exercise. The lifting mechanism is a hydraulic piston that is spring-loaded so as to allow ease of lifting, as well as returning to the storage position. In a lowered position the jerk block become a pull block. A hydraulic piston controls the closure of the jerk block to a raised or lowered position. The jerk block includes an upper member for holding of the barbells of sufficient length, preferably about 48 inches, to accommodate most lifting exercises, as well as provide a large landing area for placement of the weights for the barbells. Part of the jerk block includes a steel base for rigidity, and the remainder of the jerk block is formed from lightweight plastic so as to shield the lifting mechanism and minimize weight. The jerk block includes safety lips located on a proximal and distal end of an upper surface of the jerk blocks, with a three-inch thick rubber mat also placed on the upper surface of the jerk block, capable of accepting impact from most any weight. The jerk blocks are parallel in which a left jerk block is aligned to a right jerk block by use of a laser on one jerk block pointing to a reflector on the second jerk block. When the jerk blocks are level the laser provides an indicating sound or light flash to assure that the jerk blocks are at the exact height. A lifter can practice just the jerk by placing the barbell on the jerk blocks which would be set at approximate chest high and then the barbell would be lifted from the jerk blocks by placing the bar on his or her shoulders, standing with the bar, and then jerking the bar overhead. The benefit of the jerk blocks would then happen when the lifter lets the bar slam back on to the jerk blocks and sets up for the next lift, rather than letting the bar fall to the ground or trying to control the bar back to their shoulders.

An objective of the instant invention is to provide adjustable jerk blocks that can also serve as pull blocks.

Another objective of the instant invention is to provide a portable jerk block that can be placed in an upright position to minimize the footprint, or placed in a horizontal lowered position wherein they can operate a pull blocks or placed in a position wherein wheels allow for ease of portability.

Yet another objective of the instant invention is to provide a jerk block that employs a hydraulic foot jack that allows an individual to lift the jerk block to any particular level, wherein an optional measure device can be viewed to determine the relative placement of one jerk block height versus a second jerk block height.

Still another objective of the instant invention is to provide a release handle that is easy to access and allows for the removal of hydraulic pump pressure so as to reduce the size of the jerk block from a lifting position to a lowered position.

Yet another objective of the instant invention is to provide a method of leveling two jerk blocks by use of a light laser capable of energizing a photo cell to create a signal tone or signal light when two jerk blocks are at an equal level.

Yet another objective of the instant invention is to provide a jerk block that can accommodate any size barbell length, and any size weight, in assuring the safety of the individual by providing a large landing platform of approximately four feet by two feet.

Still another objective of the invention is to provide a jerk block that can be lowered to operate as a pull block. As a pull block, a lifter may set the barbell on the pull block so that the barbell sits just above the knee wherein the lifter could perform a "clean" or a "snatch" from that position.

Other objectives and further advantages and benefits associated with this invention will be apparent to those skilled in the art from the description, examples and claims which follow.

DETAILED DESCRIPTION OF THE INVENTION

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Figure 3:
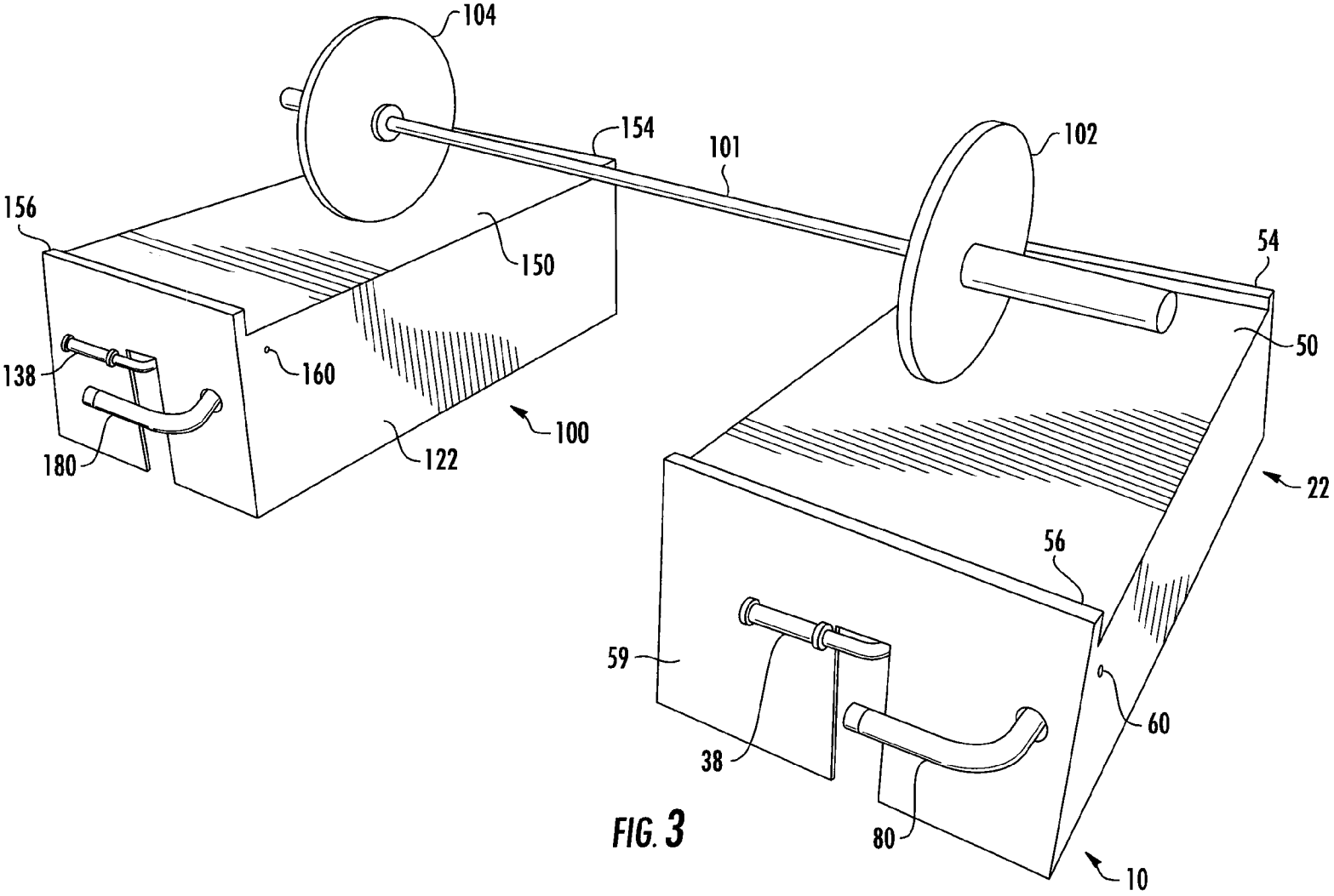
FIG. 3 is a pictorial view of a barbell placed upon the jerk blocks in a lowered position.
Figure 4:
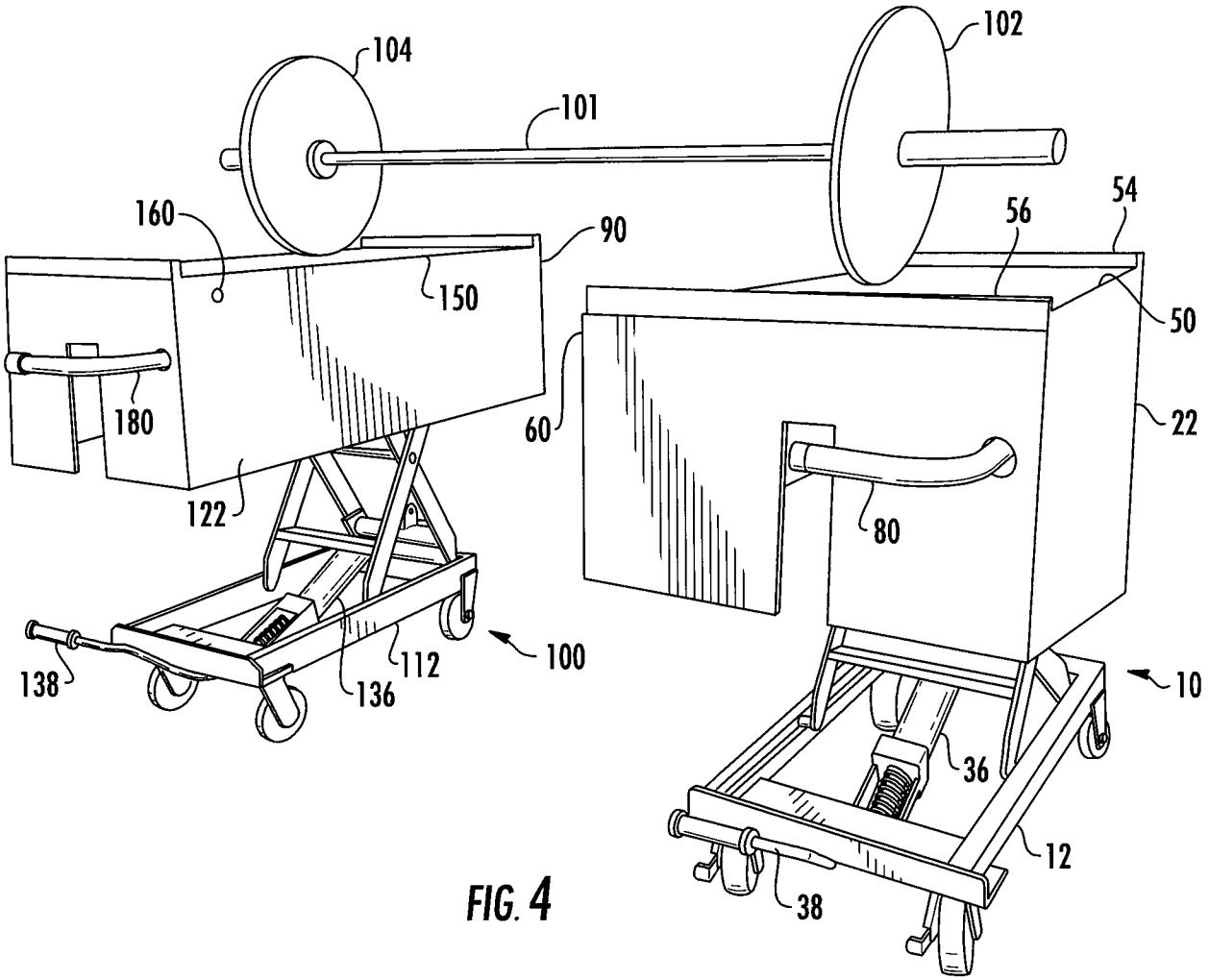
FIG. 4 is a pictorial view of a barbell placed upon the jerk blocks in a raised position.
Figure 5:
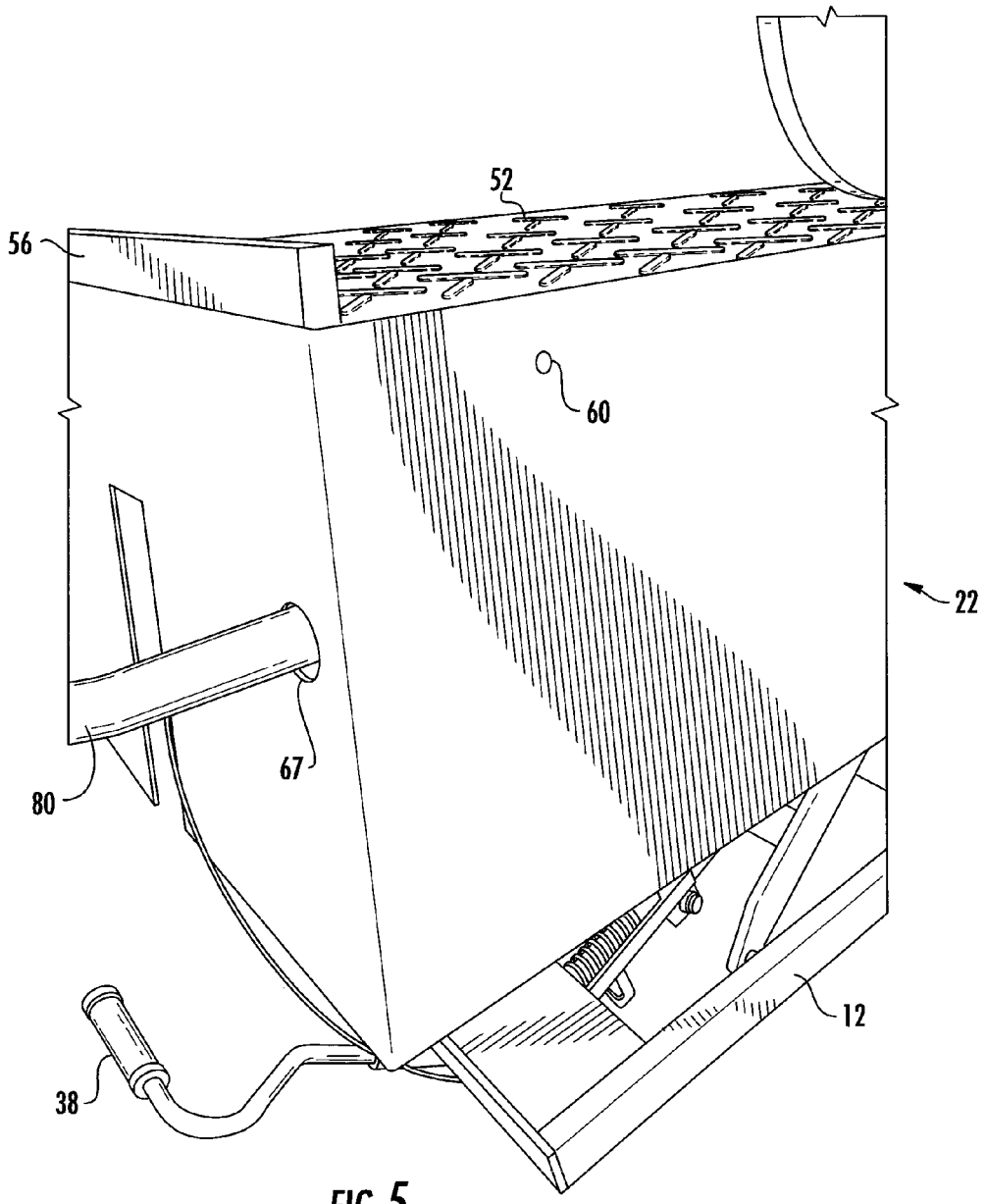
FIG. 5 is a partial view of a jerk block depicting the storage mat.

Referring now to the Figures, illustrate is a portable jerk block 10. The use of a barbell requires two lifting jerk blocks as depicted in FIGS. 3 and 4. While two lifting jerk blocks are required to hold a barbell, for ease of discussion a single lifting jerk block will be detailed herein. The second lifting jerk block is a duplicate lifting jerk block to the first jerk block, but for a laser leveler as described later in this specification.

The jerk block 10 includes a support base 12 formed from a rectangular frame 34 having first and second sidewalls 17 & 19, and first and second end walls 21 & 23. Caster wheels 14 are mounted to the base of the frame to allow ease of movement. The frame 34 includes a scissors structure consisting of a forward support having a first forward support strut 16 having a proximal end 18 pivotally secured to a first sidewall 17 of the frame 34 and a distal end 20 that is slidably secured to the bottom of the support member 22 using slide rail 24; and a second forward support strut 16' having a proximal end 18' pivotally secured to the second sidewall 19 of the frame 34 and a distal end 20' that is slidably secured to the bottom of the support member 22 using slide rail 24'.

Similarly, a rear support having a first rear strut 26 has a distal end 28 pivotally secured to the bottom of the support member 22 and a proximal end 30 that is slidably secured to the first sidewall 17 of the frame 34 using aperture 31, and a second rear strut 26' having a distal end 28' pivotally secured to the bottom of the support member 22 and a proximal end 30' that is slidably secured to the second sidewall 19 of the frame 34 using aperture 31'.

A tie beam 25 is pivotally coupled between the first and second front support struts 16 & 16' and the first and second rear support struts 26 & 26'. The tie beam 25 is preferably centrally located between the proximal and distal end of each of said struts wherein the longitudinal movement of distal ends 20 & 20' along the lower surface of the support member 22 equal the longitudinal movement of proximal ends 30 & 30' along a length of the frame 23 sidewalls. A cross support 32 is strategically positioned between the tie beam 25 and the proximal ends 18 & 18' of front support struts 16 and 16'.

An actuator having a first end secured to said first end wall of said frame and a second end secured to said cross support. In the preferred embodiment, the actuator is preferably a foot operated hydraulic jack 36 capable of pushing the cross support 32 causing the sliding movement of the ends 20 & 20' of the front support struts 16 & 16' toward the ends 28 & 28' of the rear support struts 26 & 26'. The hydraulic jack 36 is operated by a foot lever 38 that operates to internally displace hydraulic fluid to cause extension of the push rod 41 causing displacement of the cross support 32. A spring 43 operates in conjunction with the hydraulic jack 36 to assist the displacement of the push rod 41 during the actuation of the hydraulic jack 36 and further operate to counterbalance the hydraulic jack 36 upon retraction.

In a scissors-type arrangement, a pivot point made by the tie beam 25 causes the front support struts 16 & 16' and rear support struts 26 & 26' to cause displacement of the support member 22 from the base 12 as the distal ends 20 & 20' of front support struts 16 & 16' move along the lower surface of the support member 22 in an equal longitudinal movement to the proximal ends 30 & 30' of the rear support struts 26 & 26'. The tie beam 25 is preferably centrally located between the proximal and distal end of each of said struts. Pushing of the cross-support 32 by extending the push rod 41 from the actuator 36 raises the support member 22 above the base, and retraction of the push rod 41 into the actuator 36 causes the support member to be lowered. Support member 22 has an upper surface 50 which is preferably constructed from a steel plate with safety lips 54 and 56 located along each end of support member 22 to prevent a barbell from rolling off the upper surface 50. As previously mentioned, it is noted that two lifting jerk blocks 10 are required for the raising and lowering of a barbell with weights. The lifting jerk blocks are placed adjacent to each other in a spaced apart position wherein the weights located on each end of the barbell are centrally located over each of the upper surfaces 50 of the lifting jerk blocks 10.

Figure 1:
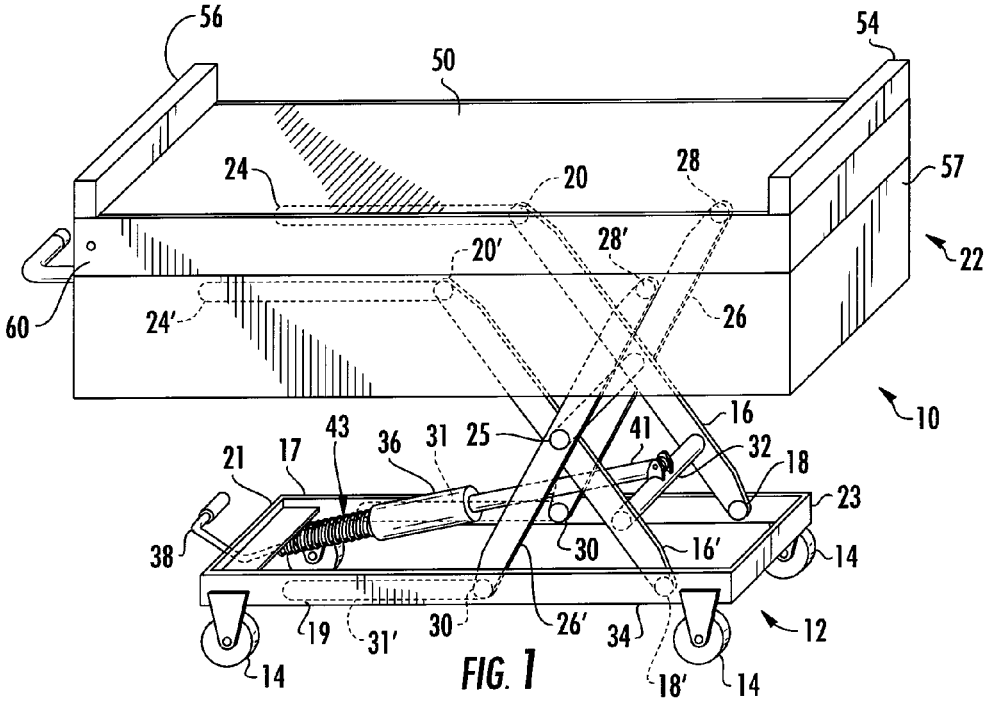
FIG. 1 is a perspective view of the jerk block in a raised position.
Figure 2:
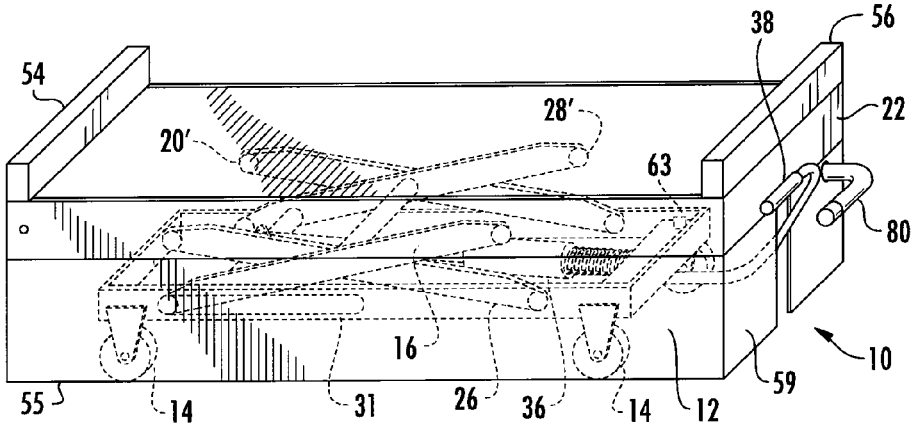
FIG. 2 is a perspective view of the jerk block in a lowered position.

As depicted in FIG. 2, the jerk block 10 is show in a lowered position. The support base 12 is illustrated with the wheels 14 secured to the base in a retracted state wherein movement is prohibited when a lower edge 55 of the support member 22 is placed flush against the floor. The storage position can be made low enough so as to conceal the wheels to eliminate movement of the support base and allow ease of tilting the support member for vertical storage. The aforementioned struts are depicted in a lowered positioned made possible by a scissors type configuration wherein distal ends of the frontal support struts and rear support struts are moved away from each other to allow for the lowering of the support member.

A lifting handle 80 facilitates the raising and lowering of the support member 22. The lifting handle 80 can include an actuator release, not shown, which simply allows the release of the hydraulic fluid to return to a position allowing the retraction of the push rod. The actuator release can be incorporated into the lifting handle 80 wherein a slight rotation of the handle 80 can be used to push a cable attached to the actuator, causing release of the fluid pressure. Alternatively the foot lever 38 can be used to raise and lower the support member 22. The handle 80 can also be used to lift the end of the lifting jerk block 10 wherein the back 57 of the jerk block can be placed upon the floor. The stacked configuration takes less floor space. In addition, the wheels 14 can be partially lowered wherein the lifting station 10 can be moved like a dolly, wherein two of the wheels engage the floor while the handle is used to lift surface 59 above the floor.

In a preferred embodiment, a laser 60 is used to assure the upper surfaces 50 of each lifting jerk block 10 are horizontally equal. The laser 60 is placed within one of the lifting jerk blocks and is oriented so that its output is generally parallel to an aiming axis 63 of an adjoining jerk block 100. The goal is to have the beam axis of a collimated light source from the laser 60 to be very perpendicular to the adjoining jerk block. A similar principle is used with commercially available laser levels (e.g. Black & Decker BDL 2005 laser level) or an off-the-shelf laser (e.g. straight line laser level from American Tool Co.). The laser light is directed to a plane that, when correctly oriented relative a surface, forms a line at the intersection of the plane with the surface. The laser pointer is battery powered and needed only for a few moments at a time wherein a lithium battery could easily provide 10 years or more of service. The laser could be turned on only while one lift is being raised or lowered by a manual switch or by use of a timer.

When mounted and aimed, an individual can "find" the aiming axis 63 on the adjoining jerk block and confirm that the jerk blocks are at a matched height. The matched height assures the operator that the barbell is placed on jerk blocks each having a support surface that is absolutely equal in elevation. The adjoining jerk block may simply have a mark on the side of the jerk block that is illuminated by the laser, or the adjoining jerk block may include a receiver such as a photo cell that emits a tone when the energy from the laser illuminates the receiver. The laser need not be a pin point laser; rather a beam having a collimated spread that will operate to energize the tone maker and is not harmful to the eyes.

Referring to FIG. 3, illustrated is the jerk block 10 & 100 with the support member 22 placed in a lowered or storage position. The support member 22 having upper surface 50 on which a barbell 101 can be placed with the associated weights 102 positioned over the support member 22. The upper surface has a front lip 54 and a rear lip 56 to prevent the weight 102 from rolling off. The foot actuator 38 protruded from the surface 59 and is available to raise or lower the support member 22 by hand or foot actuation. It is noted that second lifting jerk block 100 with the support member 122 is also placed in a lowered or storage position. The support member 122 includes upper surface 150 on which a barbell 101 can be placed with the associated weight 104 positioned over the support member 122. The upper surface 50 have a front lip 154 and a rear lip 156 to prevent the associated weight 102 from rolling off. The foot actuator 138 available to raise or lower the support member 122. It is noted that the first support member 22 and the second support member 122 can be placed at a distance as determined by the size of the barbell 100 to assure that the weights 102 and 104 are positioned approximately within the center of support area. The first lifting jerk block 10 and the second lifting jerk block 100 are identical lifting jerk blocks and can be interchanged. Both lifting jerk blocks incorporate a laser 60 and 160 that will be used for height adjustment. The lasers can be placed on either side surface of the support member, and can include the use of a photo optic generated tone signal.

Referring now to FIG. 4, illustrated is the jerk block 10 with the support member 22 placed in a raised position. The foot actuator 38 is used to pump the hydraulic jack actuator 36 which is assisted for raising the support member 22 having upper surface 50 on which a barbell 101 can be placed with the associated weights 102 & 104 positioned over the support members. In this position, the foot jack 38 on support base 12 causes the jack 36 to be raised to a level that will match a reflection from the laser 160 on the second support member 122. When the first and second support members 22 and 122 are aligned, the laser announces alignment with an audio or the measured height can be visual determined. The laser 160 emits a beam of light that indicates with the two lifting jerk blocks are in alignment. The laser can be mounted anywhere along the side surface of the support member to assure the surfaces 50 and 150 are placed on a level plane.

In the preferred embodiment the upper surface 50 includes a rubber pad 52 of about 3 inches thickness. As previously mentioned, the handle 80 used to assist in raising the support member 22 can be cabled to the jack and rotated to release pressure to jack to allow for ease of lowering the support member 22. In this embodiment the handle 80 is placed through an aperture 67 that allows for a slight turn of the handle 80. The handle 80 can be used to lift the support member without turning; the handle 80 can be used to lower the support member by pushing down on an end of the handle 80.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A jerk block apparatus formed from two lifting stations, each said lifting station comprising:

a support member having an upper surface and a lower surface;

a support base having first and second sidewalls and first and second end walls forming a rectangular frame;

a lifting mechanism formed from a first forward support strut defined by a proximal end pivotally secured to said first sidewall of the frame and a distal end slidably secured to the lower surface of the support member and a second forward support strut having a proximal end pivotally secured to the second sidewall of the frame and a distal end slidably secured to the lower surface of the support member; a first rear strut having a first end pivotally secured to the bottom of the support member and a distal end slidably secured to the first sidewall of the frame, and a second rear strut having a first end pivotally secured to the bottom of the support member and a distal end slidably secured to the second sidewall of the frame;

a tie beam pivotally coupling said first and second front support struts to said first and second rear support struts;

a cross support secured to said first and second front support struts positioned between said tie beam and said proximal ends of first and second support struts;

an actuator having a first end secured to said first end wall of said frame and a second end secured to said cross support, said actuator constructed and arranged to push the cross support causing said struts to pivot along said cross support raising said support member above said base support; a laser pointer directed from a side of a support member for engaging a side of an adjoining support member, said laser pointer illuminating a mark on the side of the adjoining support member to indicate both support members are positioned at the same height;

wherein said two lifting stations are placed adjacent to each other with the upper surface of each said support member available for receipt of a barbell whereby the upper surfaces can be raised or lowered by the actuator.

2. The jerk block apparatus according to claim 1 wherein said actuator is further defined as a hydraulic jack that displaces hydraulic fluid to cause extension of a push rod causing displacement of the cross support.

3. The jerk block apparatus according to claim 2 including a foot operated actuator for displacing of hydraulic fluid to cause extension of the push rod.

4. The jerk block apparatus according to claim 2 including a spring to assist in the extension of the push rod.

5. The jerk block apparatus according to claim 1 including a handle positioned on an end of said support member.

6. The jerk block apparatus according to claim 1 wherein said handle is coupled to said hydraulic jack for release of hydraulic fluid to lower said support member.

7. The jerk block apparatus according to claim 1 wherein said distal ends are slidably secured to said sidewalls along an elongated aperture.

8. The jerk block apparatus according to claim 1 wherein said distal ends are slidably secured to said lower surface of said support member by attachment to a slide rail.

9. The jerk block apparatus according to claim 1 wherein said caster wheels are mounted to the base of the frame.

10. The jerk block apparatus according to claim 1 wherein said tie beam is centrally located between the proximal and distal end of each of said struts.

11. The jerk block apparatus according to claim 1 wherein said mark is a photo cell that emits a tone upon receipt of laser light.

* * * * *